US008395647B2

(12) United States Patent
Suva

(10) Patent No.: US 8,395,647 B2
(45) Date of Patent: Mar. 12, 2013

(54) PRINTER WITH PIVOTABLE PLATEN

(75) Inventor: Alan J. Suva, Milwaukee, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 250 days.

(21) Appl. No.: 12/845,867

(22) Filed: Jul. 29, 2010

(65) Prior Publication Data

US 2012/0026269 A1 Feb. 2, 2012

(51) Int. Cl.
*B41J 11/04* (2006.01)

(52) U.S. Cl. ..... 347/220

(58) Field of Classification Search ..... 347/220; 400/648, 649

See application file for complete search history.

(56) References Cited

U.S. PATENT DOCUMENTS

| | | | | |
|---|---|---|---|---|
| 2,331,331 | A | 10/1943 | Lambert | |
| 4,337,001 | A | 6/1982 | Cappotto | |
| 4,615,628 | A | 10/1986 | Swinburne | |
| 4,802,633 | A | 2/1989 | Beery | |
| 4,988,224 | A | 1/1991 | Furrow et al. | |
| 5,211,491 | A | 5/1993 | Harvey | |
| 7,002,611 | B2 | 2/2006 | Mori et al. | |
| 7,234,884 | B1 | 6/2007 | Tratar | |
| 7,429,013 | B2 * | 9/2008 | Ward | 242/578.1 |
| 8,100,596 | B2 * | 1/2012 | Hsu et al. | 400/648 |
| 2009/0123208 | A1 | 5/2009 | Hsu et al. | |

FOREIGN PATENT DOCUMENTS

| | | | |
|---|---|---|---|
| EP | 1323535 | A2 | 7/2003 |
| EP | 1849616 | A1 | 10/2007 |
| KR | 300329170 | | 7/2003 |
| WO | 03072366 | A1 | 9/2003 |

OTHER PUBLICATIONS

PCT International Search Report and Written Opinion, Application No. PCT/US2011/039779, Jul. 22, 2011.

* cited by examiner

*Primary Examiner* — Huan Tran
(74) *Attorney, Agent, or Firm* — Quarles & Brady LLP

(57) ABSTRACT

A printer is disclosed including a print frame, a print head fixed relative to the print frame, a platen drive gear rotatably mounted to the print frame, and a platen assembly pivotally mounted to the print frame. The platen assembly includes a platen rotatably driven by a platen gear that is coaxial with the platen. The platen gear meshes with the platen drive gear. The platen assembly is pivotable about an axis offset from, but parallel to, an axis of rotation of the platen drive gear.

19 Claims, 6 Drawing Sheets

PRINTER WITH PIVOTABLE PLATEN

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This disclosure relates to a printer. In particular, this disclosure relates to a movable platen for a thermal transfer printer.

In most thermal transfer printers, a length of media and an ink ribbon is fed in between a thermal print head and a platen. As the media and the ink ribbon pass between the thermal print head and the platen during printing, the thermal print head selectively heats the ink ribbon along the print line so that portions of the ink on the ink ribbon transfer to the media. By selectively heating the ink ribbon as the media and the ink ribbon pass across the thermal print head, a pattern of ink including text, images, and so forth is printed onto the media.

One function of the platen is to maintain pressure on the ink ribbon and media as they pass by the thermal print head. The application of this pressure is important because, in a thermal transfer printer, if the thermal print head does not properly contact the ink ribbon and the media, then either the ink may not be sufficiently heated for transfer or, even if the ink is sufficiently heated, the ink may not be transferred to the media due to lack of pressure between the ink ribbon and the media. Ultimately, if appropriate pressure is not applied across the thermal print head, then the print quality of the printer may be compromised.

Hence, a need exists for printers having improved print quality and, specifically, for printers in which even pressure is applied by the platen over the length of the print head.

SUMMARY OF THE INVENTION

Producing even pressure across the thermal print head by the platen is a non-trivial task. This is especially the case in printers in which the platen is driven on one axial end of the platen, as there is a tendency to produce a skewing of the axis of the platen due to the applied torque. This skewing of the axis can result in greater pressure on one side of the platen than the other and poor printing quality on the side of the platen that provides less pressure. While the platen might be driven on both axial ends of the platen, this type of construction may still result in uneven loading and, further, may occupy space within the printer that prevents top-side loading of a media cartridge within the printer.

A printer is disclosed including a print frame, a print head fixed relative to the print frame, a platen drive gear rotatably mounted to the print frame, and a platen assembly pivotally mounted to the print frame. The platen assembly includes a platen rotatably driven by a platen gear that is coaxial with the platen and that meshes with the platen drive gear. The platen assembly is pivotable about an axis offset from, but parallel to, an axis of rotation of the platen drive gear.

In one form, the platen assembly may be pivotable about an axis that extends through an area of meshing of the platen drive gear and the platen gear.

The platen assembly may be actuatable between a closed position in which the platen is pivoted toward the print head and an open position in which the platen is pivoted away from the print head. The printer may further include a movable under-housing that selectively contacts the platen assembly to pivot the platen assembly into the closed position.

When the platen is pivoted toward the print head and the platen drive gear drives the platen gear, a moment produced on the platen assembly by an interaction of the platen drive gear with the platen gear may be substantially eliminated. In the closed position, a print line is established between the print head and the platen and even pressure may be maintained across the print line by the substantial elimination of the moment on the platen assembly generated by the platen gear during the driving of the platen gear by the platen drive gear.

The axis of pivoting of the platen assembly may intersect the area of the meshing of the platen drive gear and the platen gear at a point when the platen assembly is between the closed position and the open position. A total arc between the open position and the closed position may be within a range that maintains an operable meshing of the platen drive gear and the platen gear.

The platen assembly may also include a bracket that supports the platen and a hinge pin that links the bracket to the print frame and that further defines a rotational axis of the bracket relative to the print frame. This rotational axis of the hinge pin may coincide with the axis of pivoting of the platen assembly. The platen may be a part of a rotatable shaft that bears on the bracket and the platen gear may also be located on the rotatable shaft. In some forms, the bracket may include an upper bracket part that supports the platen and a lower bracket part that selectively engages a moveable under-housing to pivot the platen assembly. In this form, a torsion spring may engage the lower bracket part to bias the platen away from the print head. One or more compression springs may be interposed between the lower bracket part and the upper bracket part to bias the upper bracket part and the lower bracket part away from one another. These compression springs provide pressure between the platen and the print head when the printer is in the closed position while accommodating various thicknesses of media. Any moment produced by the meshing of the platen drive gear and the platen gear may be generated proximate the hinge pin, thereby substantially eliminating the moment on the platen assembly by reduction of the length of the moment arm.

In various forms, the printer may include additional components or have other structural features. The platen gear may be located on one axial end of the platen. An axis of rotation of the platen may be parallel to, but spaced from, the axis of pivoting of the platen assembly.

The disclosed printer offers many advantages over known printer structures. By locating a pivot axis of the platen assembly at an area of meshing of the platen gear and the platen drive gear, the application of a moment generated by gear interaction to the platen assembly is substantially eliminated. This means that the pressure applied over the length of the print head by the platen will be more uniform and uneven pressures are less likely to degrade print quality. Further, this printer design allows the platen gear and the platen drive gear to remain operably meshed throughout the range of pivotal motion of the platen assembly with minimal variation in the center-to-center distance in the platen and platen drive gears. Accordingly, the disclosed printer can accommodate a wide range of media thicknesses while still maintaining an operable mesh between the gears and, further, without sacrificing print quality due to uneven platen pressure.

These and still other advantages of the invention will be apparent from the detailed description and drawings. What follows is merely a description of a preferred embodiment of the present invention. To assess the full scope of the invention, the claims should be looked to as the preferred embodiment is not intended to be the only embodiment within the scope of the claims.

DETAILED DESCRIPTION OF THE PREFERRED EMBODIMENT

Figure 1:
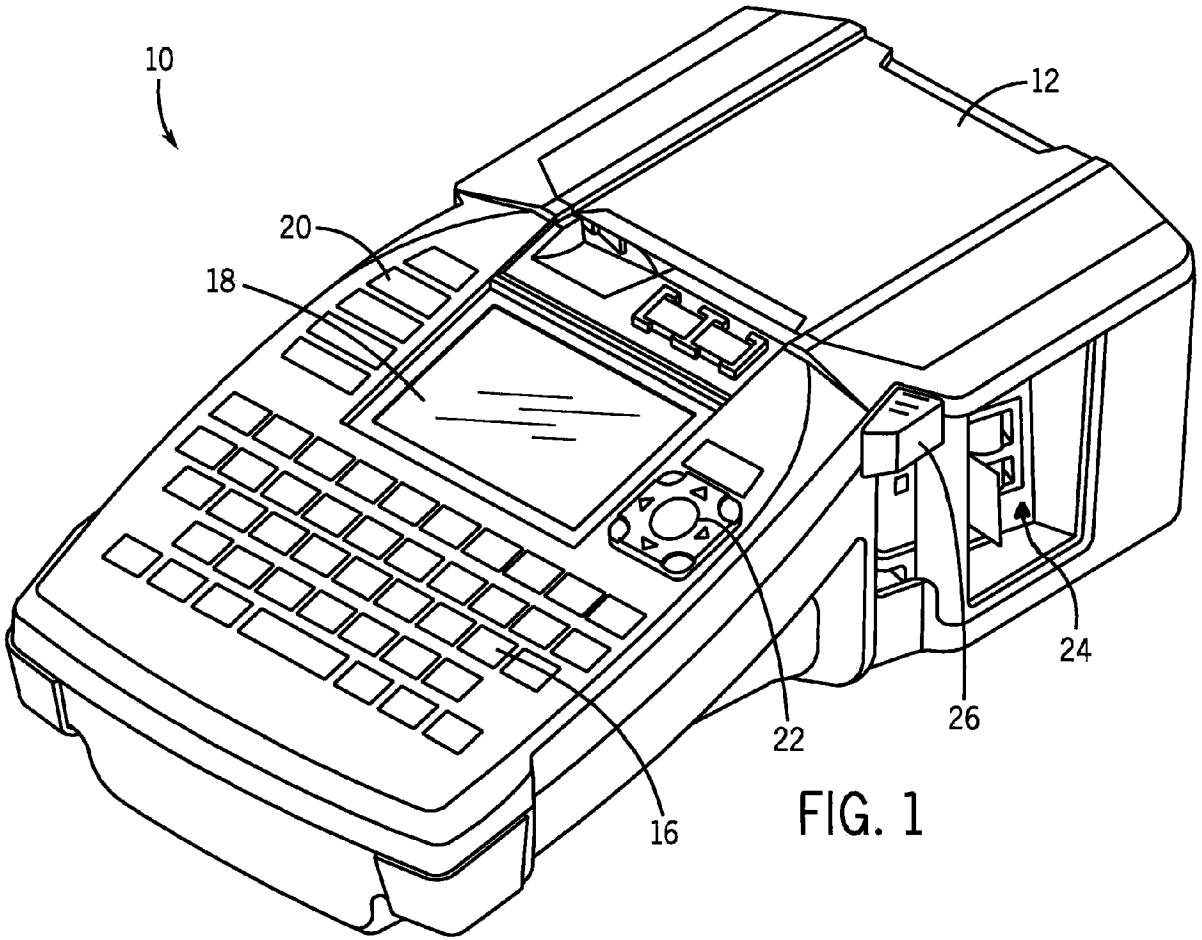
FIG. 1 is a top front side perspective view of a printer.

Referring first to FIG. 1, a printer 10 is shown. The printer 10 is of a type that receives a consumable media cartridge (not shown) that has a length of printable media and an ink ribbon. A cover 12 on the top side of the printer 10 may be opened to reveal a cartridge receptacle 14 that is partially depicted in FIGS. 2 and 3. In the cartridge receptacle 14, the media cartridge may be loaded.

In the form shown, the exterior of the printer 10 includes a number of other features, which are for purposes of illustration only and should not be considered limiting. These features include a keypad 16, a display 18, a row of buttons 20 on one lateral side of the display 18, and a directional control 22 on the other lateral side of display 18. The display 18 is used to display information related to the operation of the printer 10 such as a user interface or a text string as it is entered by the user. The keypad 16, the row of buttons 20, and the directional control 22 are all used for user entry of data into the printer 10 and/or control of the printer 10. Some of these controls may be dedicated to performing certain functions. For example, the row of buttons 20 may be used to select an item on a corresponding list of items that is displayed on the display 18 or may toggle the printer 10 between various operational modes.

Additionally, a cutting mechanism 24 is located on one lateral side of the head of the printer 10 to facilitate cutting of any media that comes out of the exit end of the printer 10. A lever 26 may be depressed to actuate a blade or the like in the cutting mechanism 24 thereby severing the media that has been printed on from the unprinted portion of the media.

Figure 2:
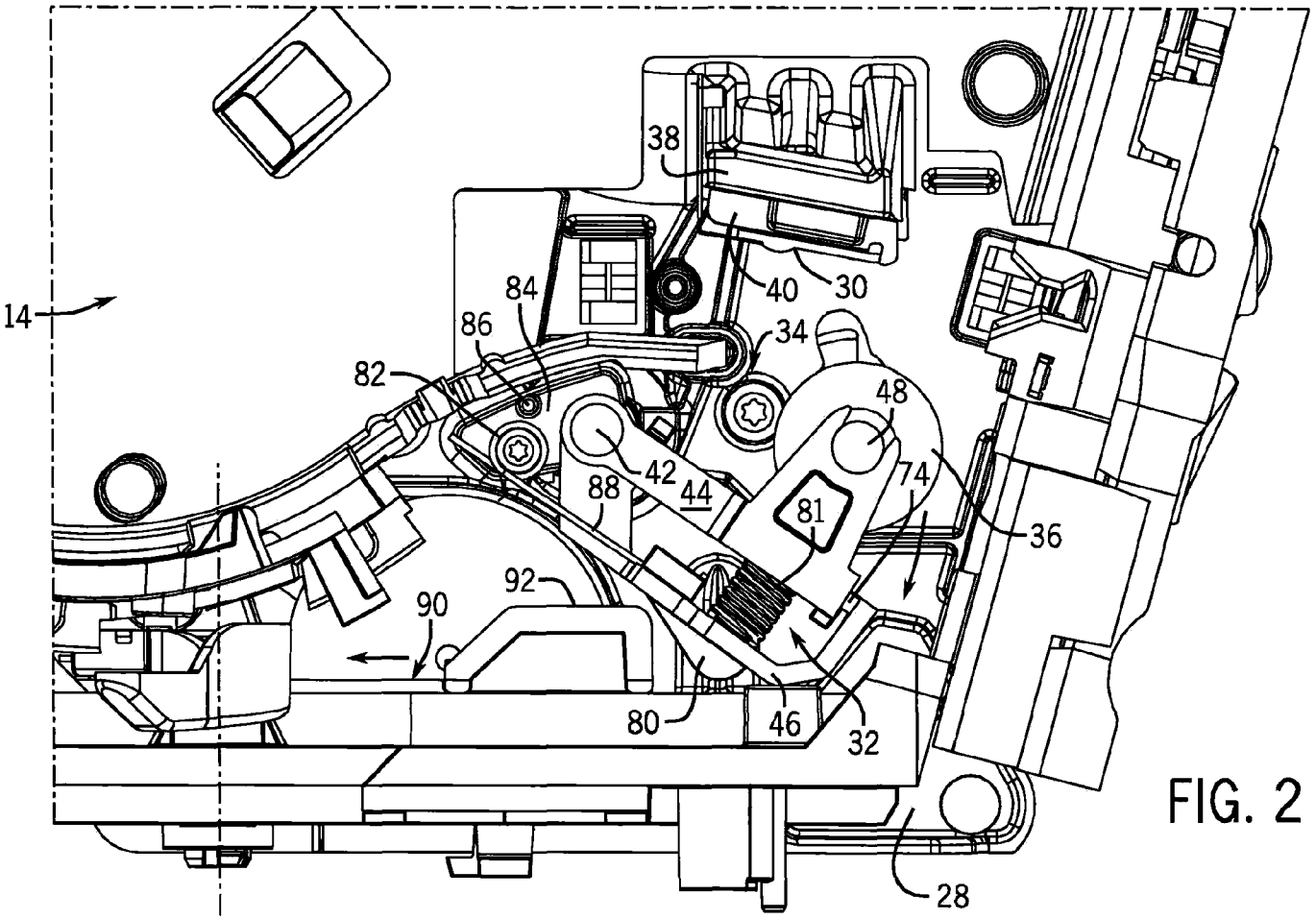
FIG. 2 is a top view of the cartridge receptacle of the printer of FIG. 1 showing the thermal print head and the platen assembly in which the platen assembly is in the open position in which the platen is pivoted away from the thermal print head.
Figure 3:
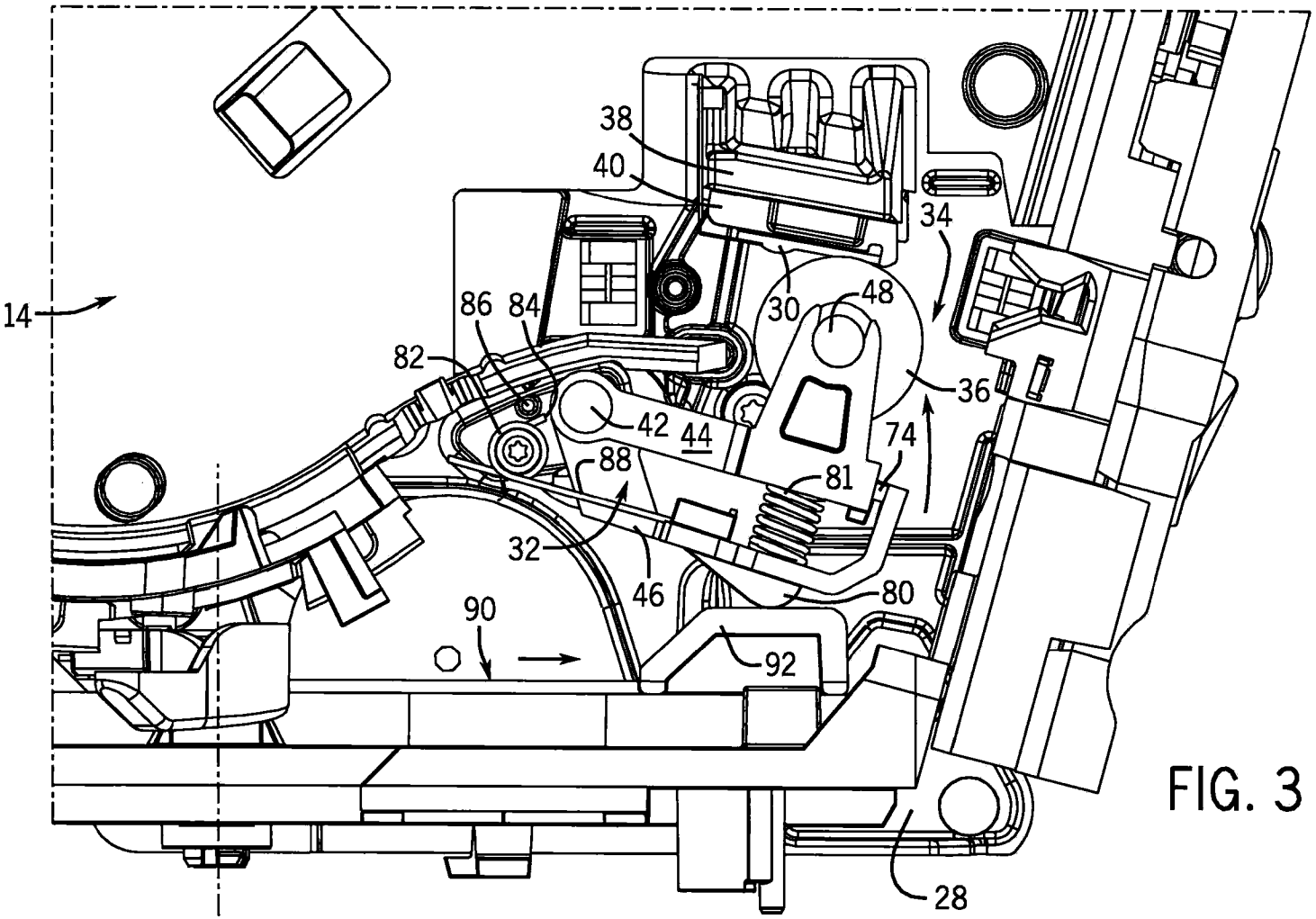
FIG. 3 is a top view of the cartridge receptacle similar to FIG. 2, but in which the platen assembly has been moved to a closed position in which the platen is pivoted toward the print head.

Referring now to FIGS. 2 and 3, the internal components of the printing mechanism in the cartridge receptacle 14 are illustrated. The printer 10 includes a print frame 28 to which various components of the printer 10 are attached. As used herein, the term "print frame" should be understood to broadly include single and multi-piece assemblies of various components of the printer 10. Generally speaking, the print frame 28 is a static body within the printer 10, although items attached to the print frame 28 may be movable.

In the detail of FIGS. 2 and 3, it can be seen that the print frame 28 supports a thermal print head 30 and a platen assembly 32. While the thermal print head 30 is fixed relative to the print frame 28, the platen assembly 32 is pivotally mounted to the print frame 28 and is retractable through an opening 34 in a wall of the cartridge receptacle 14 to selectively move a platen 36 of the platen assembly 32 toward or away from the thermal print head 30.

The thermal print head 30 extends upwardly from a base wall of the cartridge receptacle 14. In the form shown, an uprising support 38 is integrally formed in the print frame 28, although in other forms the uprising support 38 may be formed separately and affixed to the print frame 28. A heat sink 40 is attached to the uprising support 38. On the side of the heat sink 40 opposite the side attached to the uprising support 38, the thermal print head 30 is attached to the heat sink 40 using a thermal tape, adhesive, or the like. The thermal print head 30 has various sections, pixels, or the like that are independently heated or cooled during the printing process.

Figure 4:
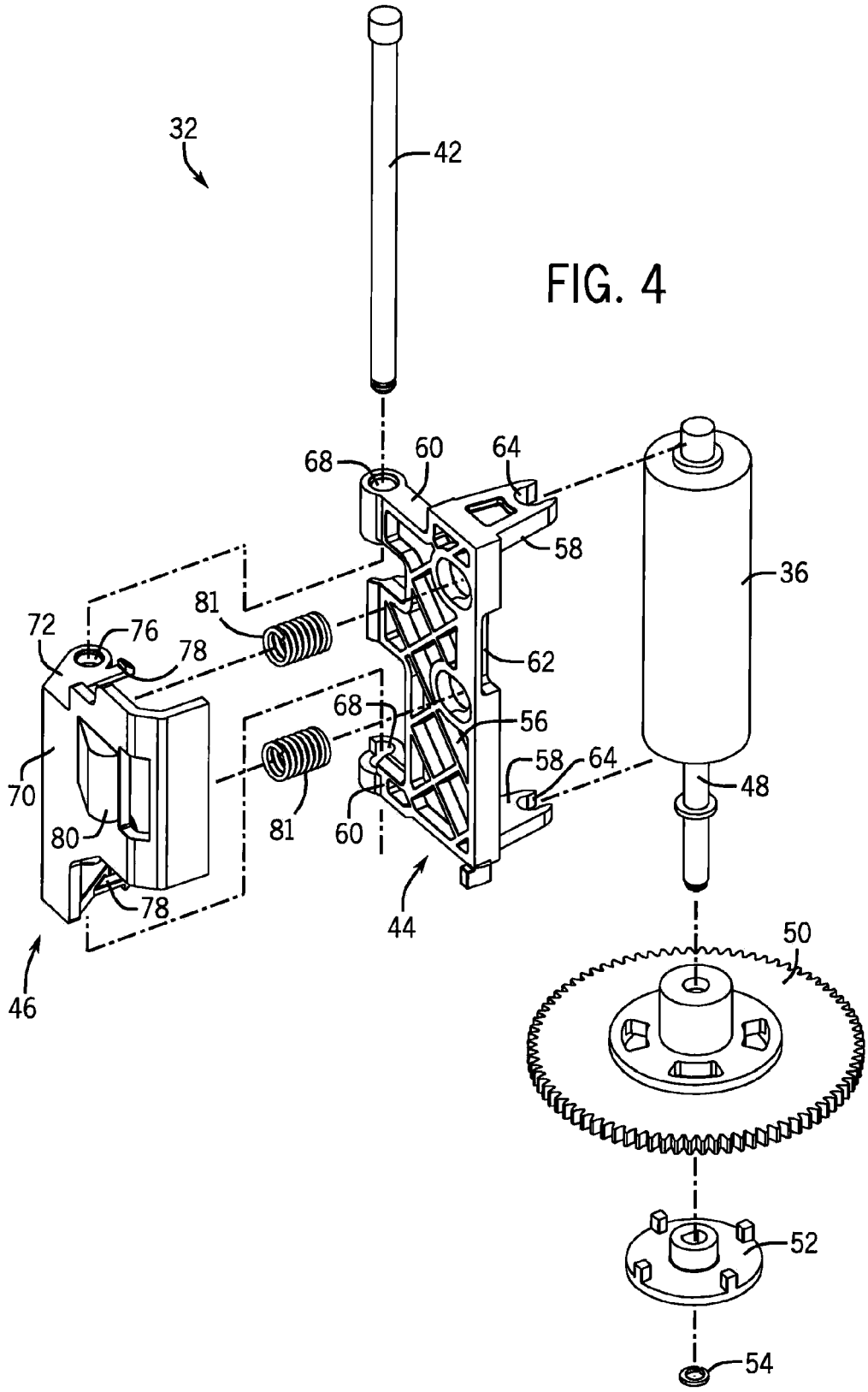
FIG. 4 is an exploded view of the platen assembly.

Now with additional reference to FIG. 4, the platen assembly 32 includes various subcomponents. The platen assembly 32 includes a hinge pin 42, a two-piece bracket including an upper bracket part 44 and a lower bracket part 46, a rotatable shaft 48 including a platen 36, and a platen gear 50 on one end of the rotatable shaft 48 that is retained thereon by a delay plate 52 and retaining washer 54. In the form shown, the platen 36 and the rotatable shaft 48 are a single component, integrally formed with one another, that move together (i.e., as the rotatable shaft 48 rotates about its axis of rotation, so does the platen 36). Accordingly, when the platen gear 50 is rotated, the platen gear 50 drives the rotation of both the rotatable shaft 48 and the platen 36.

The upper bracket part 44 includes a body 56 with two upward-extending arms 58 that are spaced from one another, two backward-projecting legs 60 that are spaced from one another, and a notch 62 formed along the upper face and on the front edge of the body 56. The two upward-extending arms 58 of the upper bracket part 44 each have a semicircular recess 64 formed therein into which a portion of the rotatable shaft 48 is seated and bears upon such that the platen 36 is situated between the two upward-extending arms 58. An elongated end of the rotatable shaft 48 further extends away from the platen 36, past one of the two upward-extending arms 58, and through an arcuate aperture 66 in the print frame 28 (best seen in FIGS. 6 and 7). The platen gear 50, the delay plate 52, and the retaining washer 54 are all attached to the rotatable shaft 48 on the elongated end of the rotatable shaft 48 that is on the other side of the print frame 28 from the platen 36. The two backward-projecting legs 60 each have a through hole 68 which are coaxial with one another and through which the hinge pin 42 is inserted as described below.

The lower bracket part 46 includes a C-shaped body 70 with a pair of spaced legs 72 on a rear end thereof and an inwardly-facing lip 74 (best seen in the side views of FIGS. 2 and 3) on the front end thereof. The pair of spaced legs 72 each have a through hole 76 which, again, are coaxial with one another and further include a upwardly-extending clip 78 that engages the upper bracket part 44. The lower bracket part 46 also has a projection 80 formed on the bottom side thereof that can be used to pivot the platen assembly 32, as will be described in more detail below.

When the lower bracket part 46 and the upper bracket part 44 are assembled, their various features interact with one another. The inwardly-facing lip 74 of the lower bracket part 46 is received in the notch 62 of the upper bracket part 44 and the pair of spaced legs 72 of the lower bracket part 46 are both placed between the two backwardly-extending legs 60 of the of the upper bracket part 44. This placement aligns the through holes 68 and 76 such that they are all coaxial with one another and the hinge pin 42 is inserted through the through holes 68 and 76 so that the walls of the through holes 68 and 76 of the bracket bear on the hinge pin 42.

A pair of compression springs 81 are placed between the upper bracket part 44 and the lower bracket part 46 to bias the upper bracket part 44 and the lower bracket part 46 away from one another. However, the upper bracket part 44 and the lower bracket part 46 are restricted from complete separation from one another. On one side, the hinge pin 42 only permits rotation of the upper bracket part 44 and the lower bracket part 46 relative to one another about the pivotal axis of the hinge pin 42. Further, the engagement of the inwardly-facing lip 74 into the notch 62 prevents the upper bracket part 44 and the lower bracket part 46 from being rotationally separated past the point of engagement of the inwardly-facing lip 74 in the notch 62.

A torsion spring 82 biases the platen assembly 32 toward the open position of FIG. 2. The torsion spring 82 has a first end 84 that engages a projection 86 on the print frame 28 and a second end 88 that applies a downward force on the lower bracket part 46. As the upper bracket part 44 and the lower bracket part 46 are linked in the manner described above, the downward biasing on the lower bracket part 46 has the effect of biasing the entire platen assembly 32, including the platen 36, into the open position.

During loading of a media cartridge into the cartridge receptacle 14 of the printer 10, the platen assembly 32 is initially positioned in the open position of FIG. 2. In this open position, the platen 36 is spaced from the thermal print head 30, such that the ink ribbon and the media can be threaded therebetween during loading. By amply spacing the platen 36 from the thermal print head 30, the likelihood that the ink ribbon or the media will catch on either of these printer components is greatly reduced.

Then, during or after the loading of the cartridge into the cartridge receptacle 14, a movable under-housing 90 is slid over from the left side of the printer 10, such that an upwardly-extending foot 92 of the movable under-housing 90 engages the projection 80 on the underside of the lower bracket part 46. This causes the bracket to overcome the downward biasing force of the torsion spring 82 and to pivot upward into the closed position of FIG. 3. This pivoting moves the platen 36 toward the thermal print head 30 to thereby define a print line therebetween. Advantageously, as discussed in further detail below, the ink ribbon and the media inserted between the thermal print head 30 and the platen 36 receives an evenly applied force over the entire print line as the platen 36 is moved toward the thermal print head 30. Note that the two-part construction of the bracket with the compression springs 81 allows the upper bracket part 44, which supports the platen 36, to be displaced somewhat downward to accommodate for thicker media and to simultaneously maintain a platen pressure across the thermal print head 30. However, this downward displacement is limited to some degree by the physical space available between the upper bracket part 44 and the lower bracket part 46.

Note that upon removal of the media cartridge, the platen assembly 32 will be retracted to the open position of FIG. 2, by moving the upwardly-extending foot 92 of the under-housing 90 away from engagement with the projection 80 on the underside of the lower bracket part 46. Once the upwardly-extending foot 92 is cleared from beneath the bracket, the torsion spring 82 biases the platen assembly 32 back into the open position.

Figure 5:
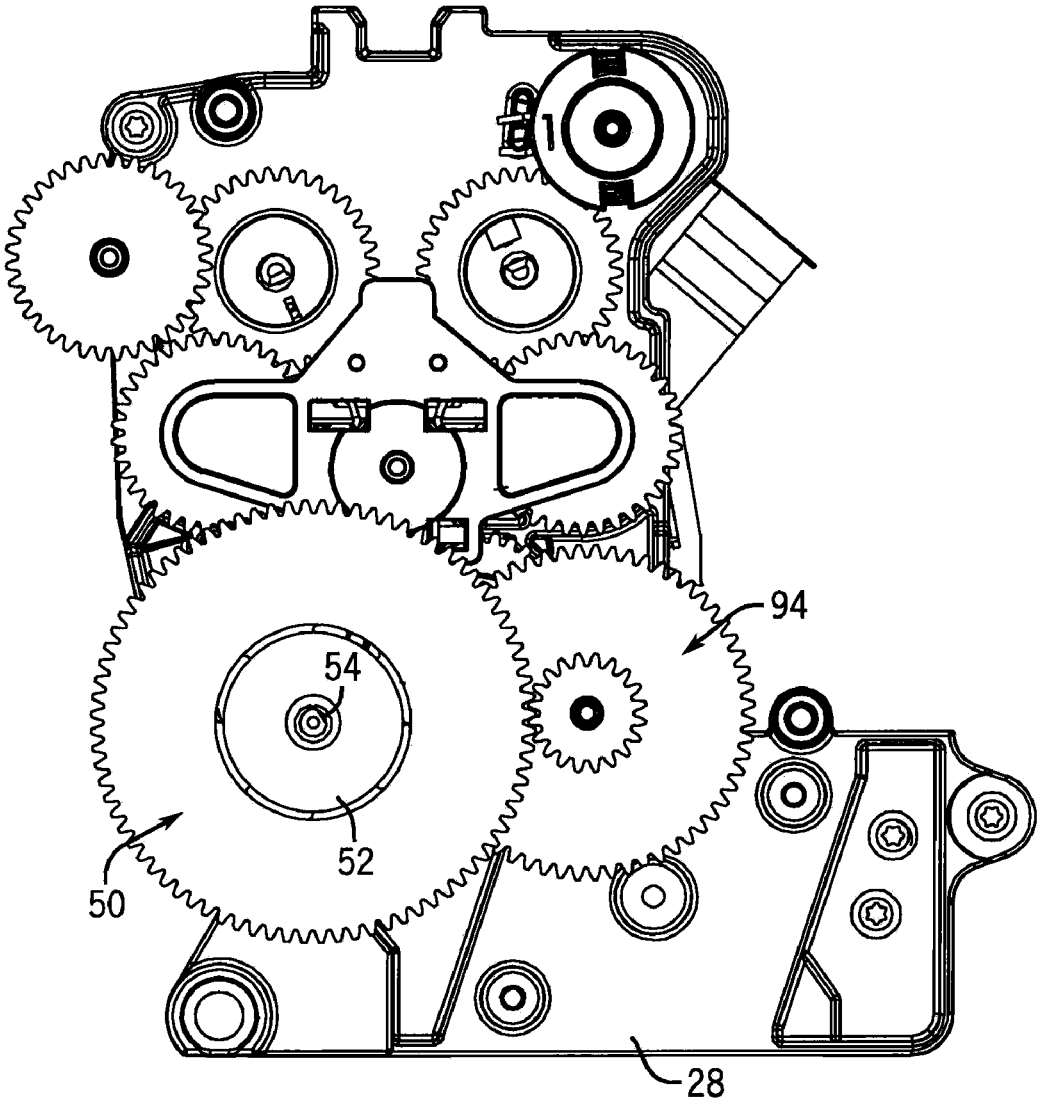
FIG. 5 is a bottom view of a portion of the printer including the gear train.
Figure 6:
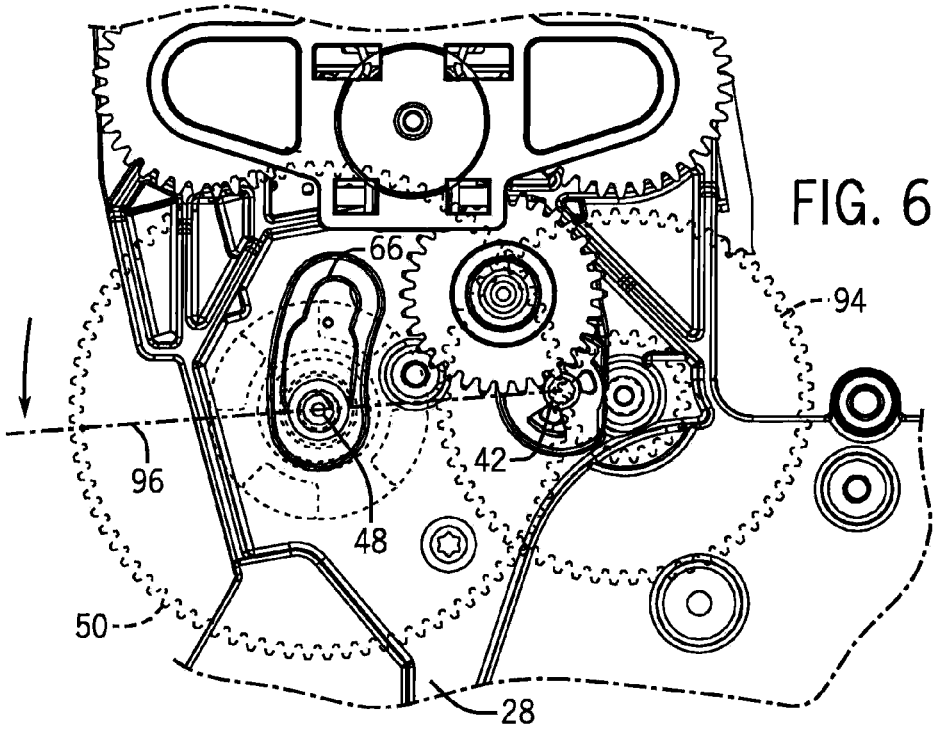
FIG. 6 is a bottom view of the gear train from FIG. 5 in which a number of gears are shown in phantom to illustrate the relationship between the gears and the platen assembly in the open position of FIG. 2.
Figure 7:
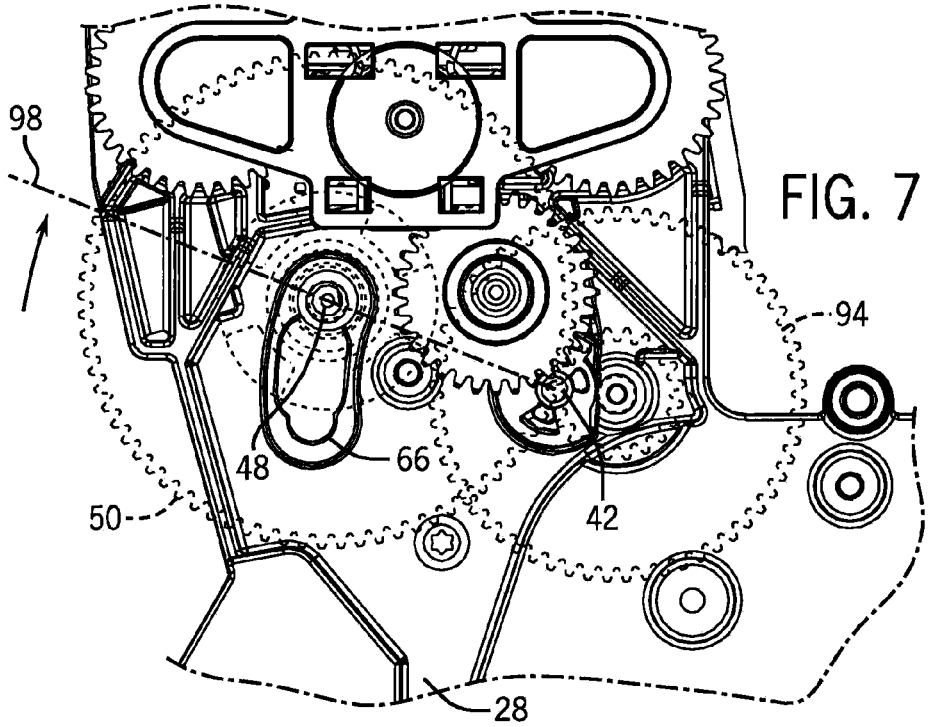
FIG. 7 is a bottom plan view similar to FIG. 6, but in which the platen assembly is moved to the closed position of FIG. 3.

Now with additional reference to FIGS. 5 through 7, the structure and arrangement of the underlying gear train is illustrated on the opposite side of the print frame 28. As best seen in FIG. 5, which is a view of the print frame 28 from the bottom side, the platen gear 50 of the platen assembly 32 intermeshes with a platen drive gear 94 on the side of the print frame 28 opposite side of the print frame 28 having the thermal print head 30 and the platen 36. In the form shown, the platen drive gear 94 is a multi-level spur gear having two sets of teeth than rotate together when the platen drive gear 94 is rotated. In this form, the set of teeth with the smaller diameter engage the platen gear 50, while the set of teeth with the larger diameter engage another gear that is driven by a motor either directly or indirectly. It is contemplated that, in some forms, the platen drive gear 94 may be directly driven by the motor itself.

The platen drive gear 94 also drives a number of gears in the gear train that are related to ink ribbon spool rotation and other operations of the printer 10. However, for purposes of this disclosure, these ancillary functions will not be described in further detail.

Now with specific reference to FIGS. 6 and 7, positions of the platen gear 50 are illustrated relative to the print frame 28 and the platen drive gear 94 in which the platen assembly 32 is in the open and the closed positions, respectively. In these figures, the platen gear 50 and the platen drive gear 94 are shown in phantom to better identify the locations of the hinge pin 42, the rotatable shaft 48, and the platen 36 relative to the locations of the platen gear 50 and the platen drive gear 94. Dotted lines 96 and 98 are drawn between the axis of rotation of the hinge pin 42 and the axis of rotation of the rotatable shaft 48 and the platen 36 in FIGS. 6 and 7, respectively. If FIGS. 6 and 7 were superimposed on one another, these dotted lines 96 and 98 would intersect one another at the hinge pin 42, which is the pivotal axis of the platen assembly 32.

From the perspective of maintaining ideal meshing of the teeth of the platen gear 50 and the platen drive gear 94, it would be preferable to have the platen gear 50 rotate about the rotation axis of the platen drive gear 94. By having the platen gear 50 rotate about the rotational axis of the platen drive gear 94, the center-to-center distances of the gears would be maintained regardless of the angular position of gears relative to one another.

In the disclosed printer 10, however, the platen gear 50 pivots about an axis which is offset radially from the rotational axis of the platen drive gear 94. Preferably, the platen gear 50 pivots about a pivotal axis which extends through the meshing of the teeth of the platen gear 50 and the platen drive gear 94. As best depicted in FIGS. 6 and 7, the axis of rotation of hinge pin 42, which corresponds to the pivotal axis of the platen assembly 32, is located such that its pivotal axis extends through the area of meshing of the platen gear 50 and the platen drive gear 94. More specifically, in the form shown, this area of meshing is the area in which the teeth of the platen gear 50 mesh with the set of teeth with the smaller diameter of the platen drive gear 94 (as the platen drive gear 94 is a multi-level spur gear).

By placing the pivotal axis of the platen assembly 32 at an area of meshing of the platen gear 50 and the platen drive gear 94, rather than at the rotational axis of the platen drive gear 94, while ideal gear meshing at some pivotal positions of the platen assembly 32 is lost, better overall print quality will result. In particular, by placing the pivotal axis of the platen assembly 32 within the area of gear meshing, a more uniform pressure is provided over the length of the platen 36 and the thermal print head 30 which, in turn, results in superior print quality.

Advantageously, the pressure applied by the platen 36 is more uniform because the driving of the gears does not generate a substantial moment on the platen assembly 32. If the platen drive gear 94 and the platen assembly 32 was pivotable about the axis of rotation of the platen drive gear 94 (as would be the case if ideal gear meshing was to be maintained), it would necessarily be the case that the area of gear teeth meshing would be different than the pivotal axis of the platen assembly 32. This would mean that, when the platen gear 50 was driven by the platen drive gear 94, a moment would be generated on the platen assembly 32 by interaction force of the platen gear 50 with the platen drive gear 94. This moment would only be generated on one lateral side of the platen assembly 32 (the side with the platen gear 50) and would induce a torsional force across the platen assembly 32. This torsional force would result in a force gradient across the platen 36, which would have the ultimate effect of creating better thermal transfer of ink in some sections of the platen 36 as opposed to others. Ultimately, print quality in some sections would be degraded.

However, according to the disclosed structure, the pivotal axis of the platen assembly 32 (i.e., in this case the hinge pin 42) coincides with the area of gear meshing. This structure substantially eliminates or at least greatly minimizes the generation of a moment on the platen assembly 32, as the length of the moment arm on the moment applied to the platen assembly 32 is reduced to zero (or near zero) by locating the pivotal axis of the platen assembly 32 proximate the location where the force is generated by the gear interaction. Minimizing the moment applied to the platen assembly 32 by the platen drive gear 94 results in evenly applied pressure over the thermal print head 30 by the platen 36 because little or no torque is generated at only one end of the platen assembly 32 as a result of the gear interaction.

This disclosed design also takes advantage of the fact that the teeth of the platen gear 50 and the platen drive gear 94 remain operably meshed within a certain amount of deviation from ideal meshing as a result of a change in the center-to-center distances of the gears. Although the acceptable amount of deviation will vary based on the form of the gears, in the shown embodiment, about a 60 degree range of pivoting can be made while maintaining the operable meshing of the gears. However, the range may vary based on the approximate center-to-center distance of the platen gear 50 and the platen drive gear 94 as well as the form and quality of the gear teeth. In any event, the teeth of the gears preferably remain operably meshed over the total arc extending from the closed to the open positions of the platen assembly 32.

In some configurations, however, the teeth of the platen gear 50 and the platen drive gear 94 may be operably meshed at or near the closed position of the platen assembly 32 and not operably meshed at or near the open position. As the gears 50 and 94 are driven in the closed position, but not at or near the open position, it is the meshing of the gears 50 and 94 at the closed position that are of particular interest from an operational viewpoint. For this reason, the pivotal axis of the platen assembly 32 and the placement of the gears 50 and 94 may be arranged such that the meshing of the gears 50 and 94 are closest to ideal meshing when the platen assembly 32 is at or near the closed position.

Further, this pivoting construction can accommodate various combined thicknesses of media and ink ribbon. When the overall thickness of the media and ink ribbon increases and the platen assembly 32 is moved to the closed position, the platen 36 and upper bracket part 44 can deflect downward against the force of the compression springs 81 and rotate toward the lower bracket part 46 about the pivotal axis of the platen assembly 32. Given the disclosed construction, the teeth of the platen gear 50 remain meshed with the teeth of the platen drive gear 94 over the pivotal range of motion of the platen assembly 32, and during pivotal deflection of the upper bracket part 44 relative to the lower bracket part 46, such that the platen 36 remains drivable throughout.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. A printer comprising:

a print frame;

a print head fixed relative to the print frame;

a platen drive gear rotatably mounted to the print frame; and a platen assembly pivotally mounted to the print frame, the platen assembly including a platen rotatably driven by a platen gear coaxial with the platen and meshing with the platen drive gear, the platen assembly being pivotable about an axis offset from an axis of rotation of the platen drive gear in which the axis extends through an area of meshing of the platen drive gear and the platen gear.

2. The printer of claim 1, wherein the platen assembly is actuatable between a closed position in which the platen is pivoted toward the print head and an open position in which the platen is pivoted away from the print head.

3. The printer of claim 2, further comprising a movable under-housing, the movable under-housing selectively contacting the platen assembly to pivot the platen assembly into the closed position.

4. The printer of claim 2, wherein, when the platen is pivoted toward the print head and the platen drive gear drives the platen gear, a moment produced on the platen assembly by an interaction of the platen drive gear with the platen gear is substantially eliminated.

5. The printer of claim 4, wherein, in the closed position, a print line is established between the print head and the platen and even pressure is maintained across the print line by substantially eliminating the moment on the platen assembly generated by the platen gear during the driving of the platen gear by the platen drive gear.

6. The printer of claim 2, wherein the axis of pivoting of the platen assembly intersects the area of the meshing of the platen drive gear and the platen gear at a point when the platen assembly is between the closed position and the open position.

7. The printer of claim 2, wherein a total arc between the open position and the closed position is within a range that maintains an operable meshing of the platen drive gear and the platen gear.

8. The printer of claim 2, wherein the platen assembly further comprises:

a bracket supporting the platen;

a hinge pin linking the bracket to the print frame and defining a rotational axis of the bracket relative to the print frame which coincides with the axis of pivoting of the platen assembly.

9. The printer of claim 8, wherein the platen is part of a rotatable shaft that bears on the bracket and wherein the platen gear is located on the rotatable shaft.

10. The printer of claim 8, wherein the bracket includes an upper bracket part and a lower bracket part, the upper bracket part supporting the platen and the lower bracket part selectively engaging a moveable under-housing to pivot the platen assembly.

11. The printer of claim 10, wherein a torsion spring engages the lower bracket part to bias the platen away from the print head.

12. The printer of claim 10, wherein at least one compression spring is interposed between the lower bracket part and the upper bracket part to bias the upper bracket part and the lower bracket part away from one another thereby providing pressure between the platen and the print head when the printer is in the closed position while accommodating various thicknesses of media.

13. The printer of claim 8, wherein any moment produced by the meshing of the platen drive gear and the platen gear is generated proximate the hinge pin, substantially eliminating the moment on the platen assembly.

14. The printer of claim 1, wherein the platen gear is located on one axial end of the platen.

15. The printer of claim 1, wherein an axis of rotation of the platen is parallel to, but spaced from, the axis of pivoting of the platen assembly.

16. The printer of claim 1, wherein the area of meshing of the platen drive gear and the platen gear is defined by an area in which teeth of the platen drive gear and teeth of the platen gear intermesh with one another.

17. A printer comprising:

a print frame;

a print head fixed relative to the print frame;

a platen drive gear rotatably mounted to the print frame; and a platen assembly pivotally mounted to the print frame, the platen assembly including a platen rotatably driven by a platen gear coaxial with the platen and meshing with the platen drive gear, the platen assembly being pivotable about an axis extending through an area of meshing of the platen drive gear and the platen gear.

18. The printer of claim 17, wherein the platen assembly is pivotable about an axis offset from an axis of rotation of the platen drive gear.

19. The printer of claim 17, wherein the area of meshing of the platen drive gear and the platen gear is defined by an area in which teeth of the platen drive gear and teeth of the platen gear intermesh with one another.

* * * * *